US005593519A

United States Patent [19]

Blankenship, Jr. et al.

[11] Patent Number: 5,593,519

[45] Date of Patent: Jan. 14, 1997

[54] SUPERSOLVUS FORGING OF NI-BASE SUPERALLOYS

[75] Inventors: Charles P. Blankenship, Jr.; Michael F. Henry, both of Niskayuna, N.Y.

[73] Assignee: General Electric Company, Schenectady, N.Y.

[21] Appl. No.: 271,611

[22] Filed: Jul. 7, 1994

[51] Int. Cl.[6] ..... C22F 1/10

[52] U.S. Cl. ..... 148/514; 148/677; 148/556; 419/29; 419/42

[58] Field of Search ..... 148/675, 676, 148/677, 514, 555, 556; 419/67, 28, 29, 44, 41–42

[56] References Cited

U.S. PATENT DOCUMENTS

| | | | |
|---|---|---|---|
| 4,579,602 | 4/1986 | Pavlonis et al. | 148/677 |
| 4,685,977 | 8/1987 | Chang | 148/675 |
| 4,820,358 | 4/1989 | Chang . | |
| 5,302,217 | 4/1994 | Gostic et al. | 148/675 |
| 5,393,483 | 2/1995 | Chang | 148/677 |

FOREIGN PATENT DOCUMENTS

| | | | |
|---|---|---|---|
| 9218659 | 10/1992 | WIPO | 148/677 |
| 9413849 | 6/1994 | WIPO | 148/677 |

OTHER PUBLICATIONS

A Dictionary of Metallurgy; A. D. Merriman 1958 pp. 114–115.

*Primary Examiner*—James Engel
*Assistant Examiner*—Margery S. Phipps
*Attorney, Agent, or Firm*—Noreen C. Johnson; William H. Pittman

[57] ABSTRACT

A method of supersolvus forging is described for Ni-base superalloys, particularly those which comprise a mixture of γ and γ′ phases, and most particularly those which contain at least about 40 percent by volume of γ′. The method permits the manufacture of large grain size forged articles having a grain size in the range of 50–150 μm. The method comprises the selection of a fine-grained forging preform of a Ni-base superalloy. Supersolvus forging in the range of 0°–100° F. above the alloy solvus temperature then performed at slow strain rates in the range of 0.01–0.001 $s^{-1}$. Subsequent supersolvus annealing followed by controlled cooling may be employed to control the distribution of the γ′, and hence influence the alloy mechanical and physical properties. The method may also be used to produce location specific grain sizes and phase distributions within the forged article.

22 Claims, 4 Drawing Sheets

SUPERSOLVUS FORGING OF NI-BASE SUPERALLOYS

BACKGROUND OF THE INVENTION

This invention is generally directed to a method for forging Ni-base superalloys so as to produce a substantially uniform, large grain size microstructure. Specifically, the method comprises isothermally forging fine-grained Ni-base superalloy preforms at slow strain rates in a range of temperatures that are above the γ' solvus temperature of the superalloy of interest. In a preferred embodiment, the method also comprises additional annealing of the forged article in a range of temperatures which are also above the γ' solvus temperature followed by controlled cooling to a temperature below the γ' solvus.

Advanced Ni-base superalloys, such as those used for turbine disk applications, are currently isothermally forged at relatively slow strain rates and temperatures below their γ' solvus temperatures. This method tends to minimize forging loads and die stresses, and avoids fracturing the items being formed during the forging operation. It also permits superplastic deformation of the alloy in order to minimize retained metallurgical strain at the conclusion of the forming operation. However this method also can have substantial limitations. In particular, it can produce an relatively fine-grain as-forged microstructure having an average grain size on the order of about 7 μm. Alloys forged in this manner also have a tendency to exhibit critical grain growth as discussed further below.

For advanced applications, particularly high temperature applications, it is desirable to be able to produce articles from Ni-base superalloys that have a grain size within the range of about 50–150 μm to promote damage tolerance, such as crack propagation resistance and high temperature creep resistance. Also, in advanced applications such as turbine disks, it may be desirable to have location specific properties, such as a finer grain size in the bore for enhanced low temperature strength and low cycle fatigue (LCF) resistance, coupled with a larger grain size in the rim for damage tolerance and high temperature creep resistance.

Larger grain sizes may be achieved using related art techniques. One method for increasing grain size, and improving the properties described above, is shown schematically in FIG. 1. This method includes isothermal forging 60 at a subsolvus temperature ($T_{SB}$) and slow strain rates as described above, followed by supersolvus annealing 70 at a temperature ($T_{SP}$) in the range of 0°–100° F. above the solvus temperature, followed by controlled cooling 75. However, most Ni-base superalloys tend to achieve a grain size in the range of only about 20–30 μm when processed in this way. Also, unless carefully controlled so as to avoid retained strain in the alloy after forging, this method is subject to the problem of critical grain growth, wherein the retained strain in the forged article is sufficient to cause the random nucleation and growth (in regions containing the retained strain) of very large grains within the forged article, from for example 300–3000 μm. Isothermal forging followed by supersolvus heat treatment has been shown to produce a large grain size, in the range of 100–300 μm, in Ni-18Co-12Cr-4Mo-4Al-4Ti-2Nb-0.035Zr-0.03C-0.03B, an advanced Ni-base superalloy also known by the tradename KM4. However, this particular result is not reproducible in Ni-base superalloys generally, but limited to this particular alloy composition. Also, grain sizes in the range of about 150–300 μm are generally considered to be less desirable because of the attendant reduction in the low temperature strength of the alloy that is associated with these larger grain sizes.

Therefore, new methods of forging are required to produce articles having a controlled range of grain sizes as described above.

SUMMARY OF THE INVENTION

This invention describes a method of isothermally forging Ni-base superalloys above their γ' solvus temperature at slow strain rates in order to produce alloys having a controlled range of grain sizes. Characteristically, these grain sizes range from about 50–150 μm.

The method of forging comprises the steps of: selecting a forging preform formed from a Ni-base superalloy and having a microstructure comprising a mixture of γ and γ' phases, wherein the γ' phase a γ solvus temperature and an incipient melting temperature. occupies at least 40% by volume of the Ni-base superalloy; and forging the forging preform at a temperature that is above the γ' solvus temperature and below the incipient melting temperature of the Ni-base superalloy and at a strain rate in the range of 0.01–0.0001 $s^{-1}$ for a time sufficient to form the forging preform into a forged article.

Further, the method may also incorporate a subsequent step of supersolvus annealing in the range of 0°–100° F. above the γ' solvus temperature followed by controlled cooling of the forged article to a temperature lower than the γ' solvus, which in turn controls the distribution of the γ' phase both within and between the γ grains. Consequently, the annealing/cooling step can be used to alter the mechanical properties of these alloys, particularly the high temperature properties such as creep resistance and crack propagation resistance. The method described herein is particularly suited for use with fine-grained γ' Ni-base superalloy preforms, such as those formed by hot-extrusion of the preform from superalloy powders.

One object of the method of the present invention is to control the grain size of forged articles made from Ni-base superalloys within the range of about 50–150 μm.

A second object is to control the distribution of γ' both within and between the γ grains, and particularly to produce fine γ' particles within the γ grains and γ' along the grain boundaries.

A third object is to avoid the problem of critical grain growth induced by the presence of retained strain within the forged article.

A fourth object is to produce location specific mechanical property improvements, such as increased high temperature creep resistance and crack propagation resistance, through the location specific control of grain size by employing different cooling rates at various locations within a forged article made from Ni-base superalloys.

A significant advantage of the present invention is that it avoids the problem of critical grain growth.

Another significant advantage of the method of the present invention, is that it provides a method of making large grain size Ni-base superalloys using the same supersolvus annealing step as is utilized to make fine grain size Ni-base superalloys, as described in the method incorporated by reference herein. Therefore, Applicants believe that it is possible to use the method of the present invention in conjunction with the referenced method to develop different location specific grain sizes, and hence properties, within a single forged article.

These objects, features and advantages of the present invention may be better understood in view of the following description provided herein, particularly the drawings and specification.

DETAILED DESCRIPTION OF THE INVENTION

Figure 1:
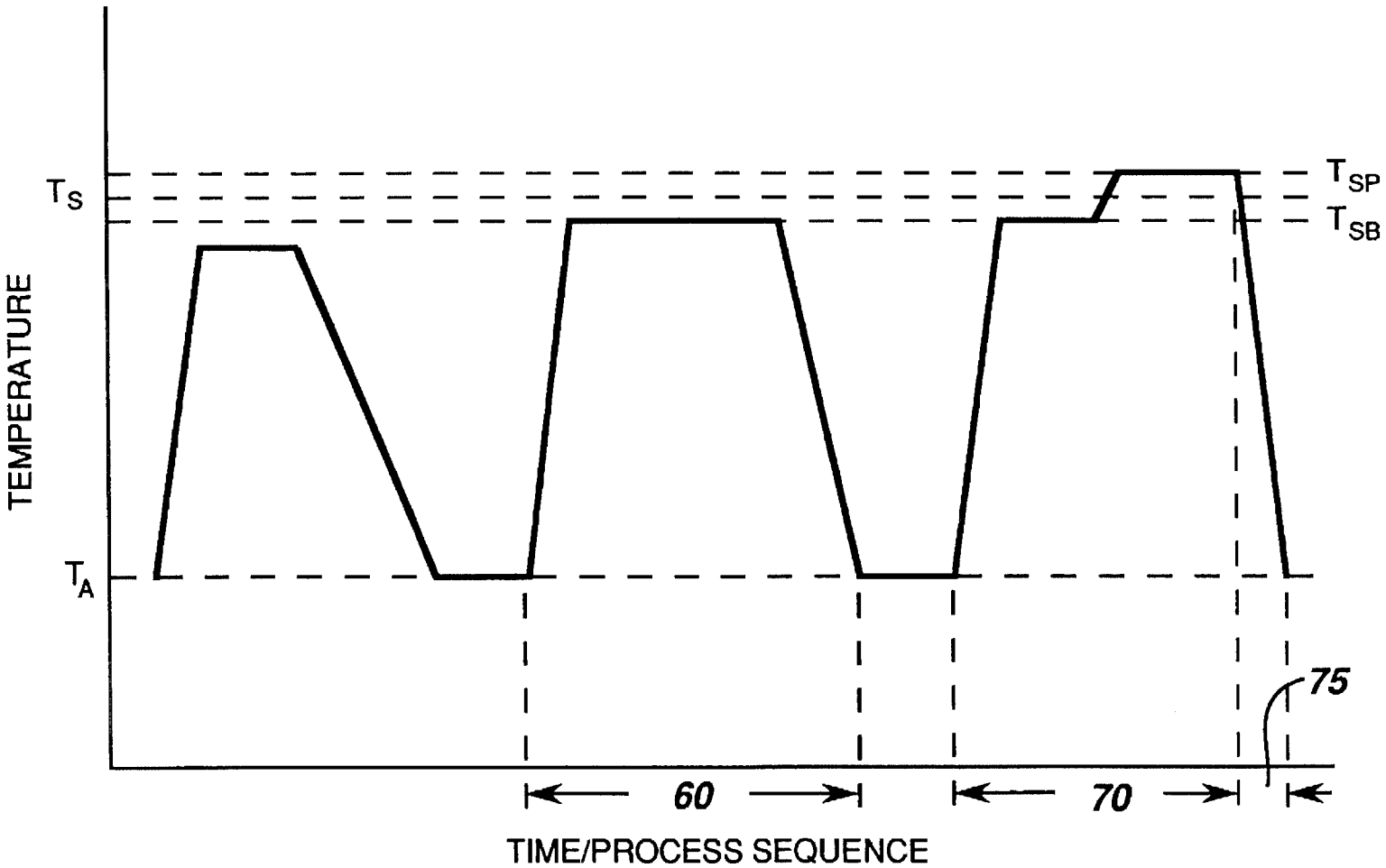
FIG. 1 is a schematic illustration of a related art method for forging Ni-base superalloys.
Figure 2:
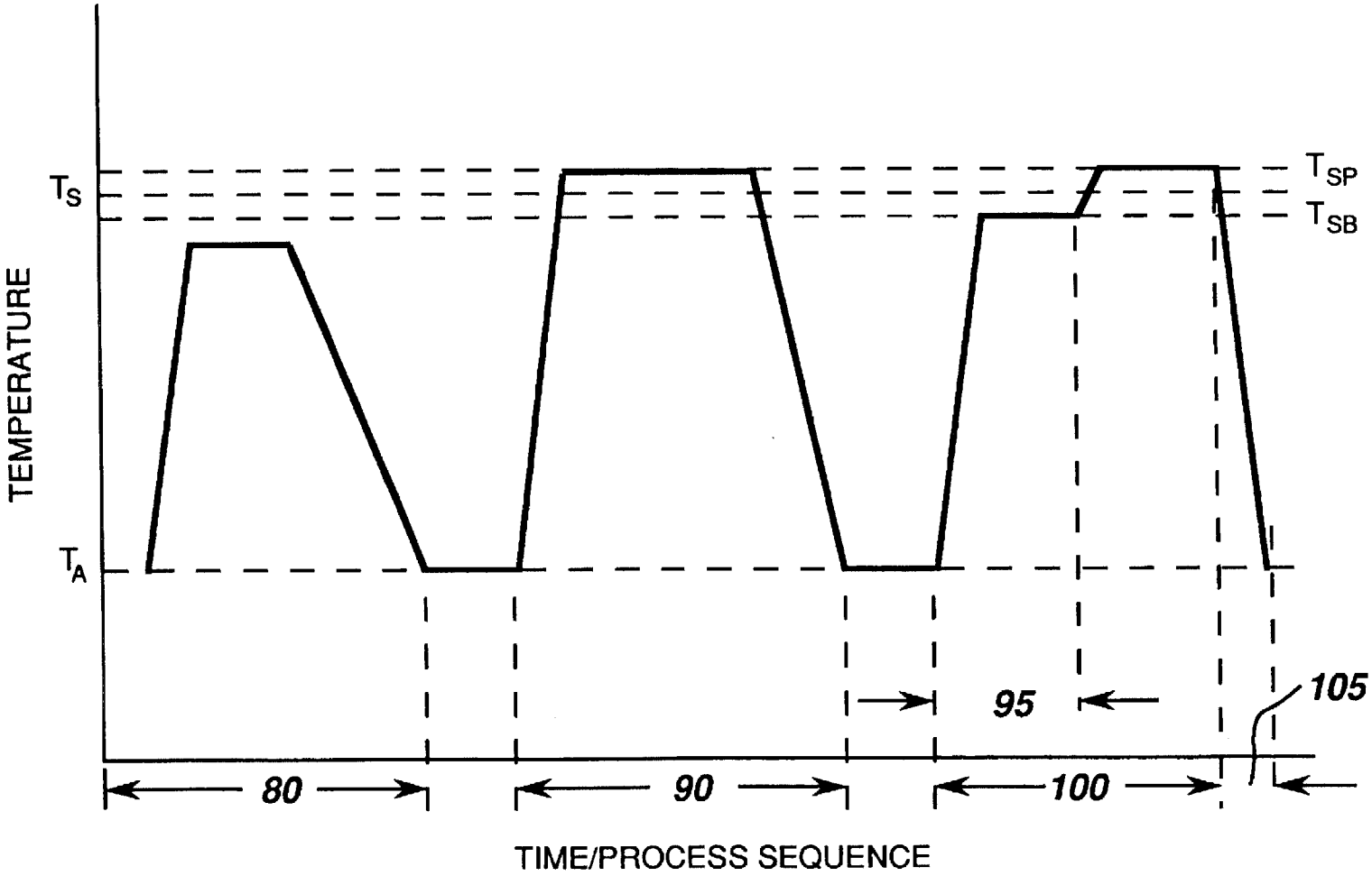
FIG. 2 is a schematic representation of a method of forging of the present invention.

FIG. 2 is a schematic representation of a preferred embodiment of the method of the present invention. FIG. 2 illustrates the process temperature as a function of the process sequences, as well as particular time intervals within some of the process sequences. The process begins with the step of forming a forging preform 80. A forging preform (not illustrated) may be of any desired size or shape that serves as a suitable preform, so long as it possesses characteristics that are compatible with being formed into a forged article, as described further below. The preform may be formed 80 by any number of well-known techniques, however, the finished forging preform should have a relatively fine grain size within the range of about 1–40 μm. In a preferred embodiment, the forming 80 of the forging preform is accomplished by hot-extruding a Ni-base superalloy powder, such as by extruding the powder at a temperature sufficient to consolidate the particular alloy powder into a billet, blank die extruding the billet into the desired shape and size, and then hot-extruding to form the forging preform. For Rene'88 powder, the hot-extrusion was performed at a temperature of about 1950° F. Preforms formed by hot-extrusion typically have a grain size on the order of 1–5 μm. Another method for forming may comprise the use of plasma spray formed preforms, since articles formed in this manner also characteristically have a relatively fine grain size, on the order of about 20–40 μm.

The method of the present invention is principally directed for use with Ni-base superalloys that exhibit a mixture of both γ and γ' phases, and in particular those superalloys that have at least about 40 percent or more by volume of the γ' phase at ambient temperatures. Table 1 illustrates a representative group of Ni-base superalloys for which the method of the present invention may be used and their compositions in weight percent.

TABLE 1

| | | | Alloys | | | |
|---|---|---|---|---|---|---|
| Element | Rene'88 | Rene'95 | IN-100 | U720 | Wasp-aloy | Astro-loy |
| Co | 13 | 8 | 15 | 14.7 | 13.5 | 15 |
| Cr | 16 | 14 | 10 | 18 | 19.5 | 15 |
| Mo | 4 | 3.5 | 3 | 3 | 4.3 | 5.25 |
| W | 4 | 3.5 | 0 | 1.25 | 0 | 0 |
| Al | 1.7 | 3.5 | 5.5 | 2.5 | 1.4 | 4.4 |
| Ti | 3.4 | 2.5 | 4.7 | 5 | 3 | 3.5 |
| Ta | 0 | 0 | 0 | 0 | 0 | 0 |
| Nb | 0.7 | 3.5 | 0 | 0 | 0 | 0 |
| Fe | 0 | 0 | 0 | 0 | 0 | 0.35 |
| Hf | 0 | 0 | 0 | 0 | 0 | 0 |
| Y | 0 | 0 | 1 | 0 | 0 | 0 |

TABLE 1-continued

| | | | Alloys | | | |
|---|---|---|---|---|---|---|
| Element | Rene'88 | Rene'95 | IN-100 | U720 | Wasp-aloy | Astro-loy |
| Zr | 0.5 | 0.05 | 0.06 | 0.03 | 0.07 | 0 |
| C | 0.5 | 0.07 | 0.18 | 0.04 | 0.07 | 0.06 |
| B | 0.015 | 0.01 | 0.014 | 0.03 | 0.006 | 0.03 |

These alloys characteristically have substantially γ grains, with γ' distributed both within the grains and along the grain boundaries, with the distribution of the γ' phase depending largely on the thermal processing of the alloy.

However, the method of the present invention does not require the forming 80 of an alloy preform. It is sufficient as a first step of the method of the present invention to merely select 85 a Ni-base superalloy preform having the characteristics described above. The selection 85 of forging preform shapes and sizes in order to provide a shape that is suitable for forging into a finished or semifinished article is well known to those of ordinary skill.

Referring again to FIG. 2, after forming 80 or selecting 85 an Ni-base superalloy preform, the next step in the method is the step of forging 90 the preform to form a forged article (not shown). Forging 90 is done at a supersolvus temperature with respect to the selected 85 Ni-base superalloy. The supersolvus forging temperature should be in the range of about 0–100° F. above the solvus temperature of the selected superalloy. Higher temperatures are possible in some cases, but are generally avoided due to the possibility of causing incipient melting. In a preferred embodiment, forging 90 is done isothermally within the range of temperatures indicated. Applicants have determined that the strain rates used for the step of forging 90 should be relatively lower with respect to strain rates currently used to isothermally form these superalloys, in the range of about 0.01–0.0001 $s^{-1}$.

Applicants have observed that forging 90 produces forged articles having a grain size in the range of 50–150 μm as measured using the mean linear intercept method as described in ASTM E-112, a standard for making grain size determinations. This also indicates that the maximum grain size is about 150 μm which is a desirable limit for many high temperature applications of these alloys, because this grain size provides a tradeoff in that the alloys have enhanced high temperature creep characteristics and crack propagation resistance while maintaining sufficient low temperature strength. Also, forging 90 under these conditions avoids retained strain and the problem of critical grain growth described above.

Forging 90 then generally comprises: heating the preform to the forging temperature, forging the preform at the temperatures and strain rates conditions described above, and cooling the forged article below the solvus temperature, generally to ambient temperature. Applicants have observed that in a preferred embodiment, the cooling rate after forging 90 should be in the range of 100°–600° F./minute in order to control the distribution of γ' phase so as to produce both fine γ' particles within the γ grains as well as γ' within the grain boundaries.

Because of the practical difficulties of controlling the cooling rate of the forged article while it is within the forge, it is often desirable to not attempt to control the rate of cooling after forging, and rather to utilize an additional step to promote control of the γ' phase distribution. In such cases, referring again to FIG. 2, it is often desirable to utilize an additional step of supersolvus annealing 100. In a preferred embodiment, prior to supersolvus annealing 100, the forged article is subjected to subsolvus annealing 95 at a temperature $T_{SB}$, where $T_{SB}$ is in the range of about (0°–75° F.) less than $T_S$. This step serves to ensure that the substantially all of the forged article is at temperature prior to the dissolution of the γ'. Such subsolvus annealing 95 is well-known in the art. The subsolvus annealing 95 time depends on the thermal mass of the forged article. Immediately after this step, the forged article is raised to the supersolvus annealing 100 temperature ($T_{SP}$) where it is annealed in the range of about 15 minutes to 2 hours depending on the thermal mass of the forged article and the time required to ensure that substantially all of the article has been raised to a supersolvus temperature. In addition to dissolution of the γ' in preparation for subsequent controlled cooling to control the γ' phase distribution, this anneal is also believed to contribute to the stabilization of the grain size of the forged article. $T_{SP}$ is in the range of about 0°–100° F. above $T_S$.

Figure 3:
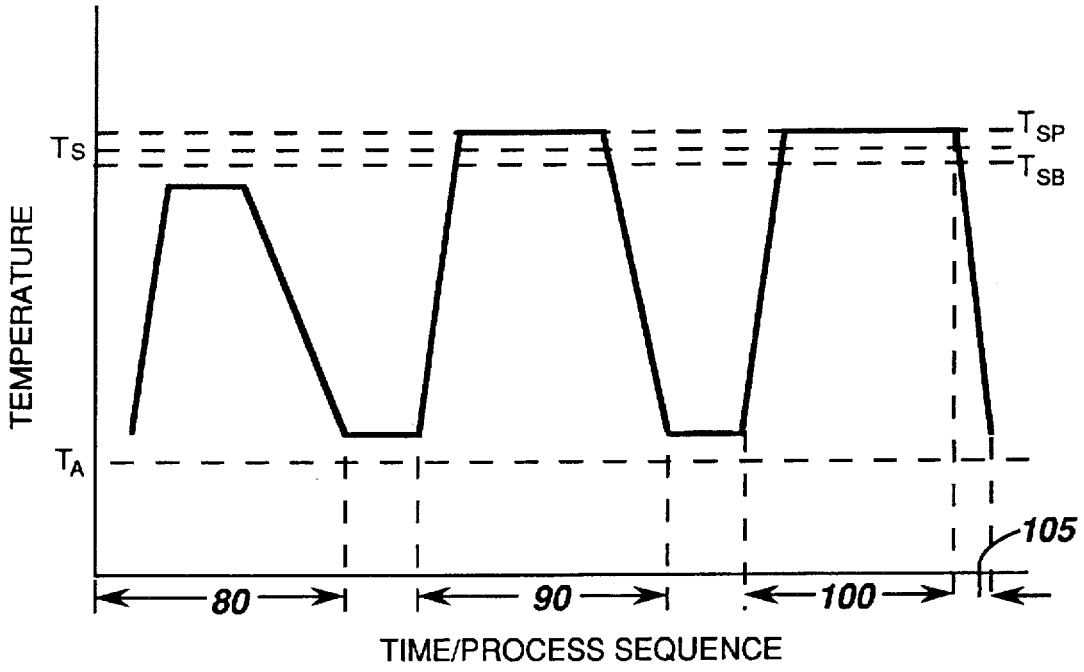
FIG. 3 is a schematic representation of a second embodiment of the method of forging of the present invention.

Referring now to FIG. 3, FIG. 3 illustrates how the supersolvus forging 90 and supersolvus annealing 95 of the method of the present invention may also be done without subsolvus annealing, particularly for forged articles having a relatively small thermal mass.

Figure 3A:
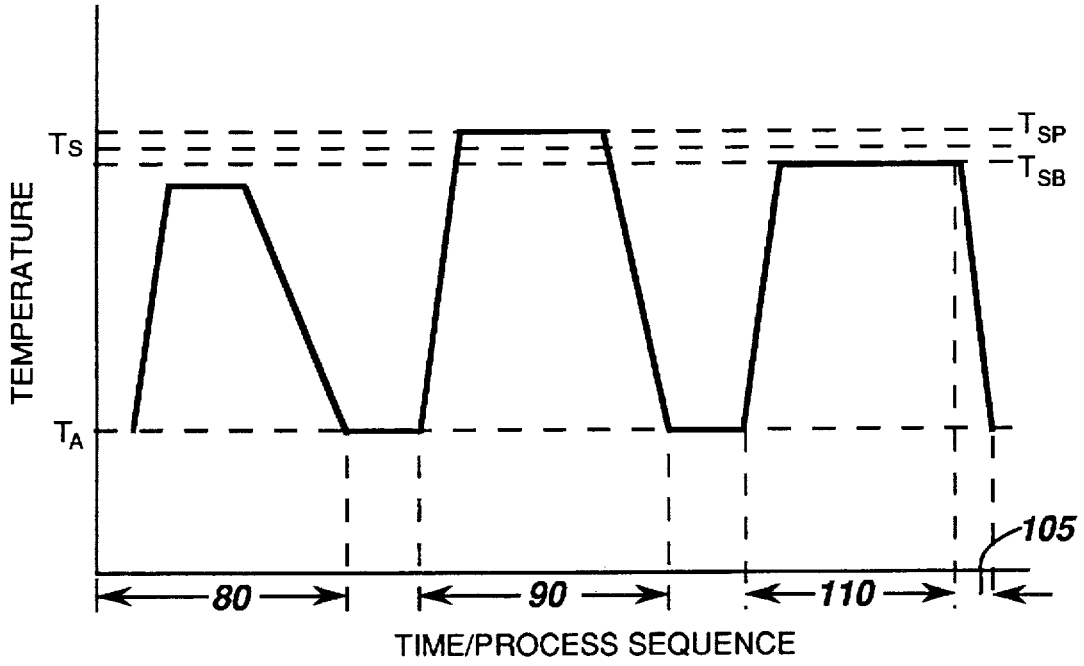
FIG. 3A is a schematic representation of a third embodiment of the method of forging of the present invention.

Referring to FIG. 3A, while not generally preferred, it is also possible to perform the post-forging annealing described above entirely by subsolvus annealing 110, in a range of about 0°–125° F. below $T_S$, for times that are generally longer than the times employed for supersolvus annealing. In such cases, the γ' is not completely dissolved, resulting upon cooling in the existence of both primary and secondary γ'. The fact that all of the γ' is not dissolved during the subsolvus annealing is believed to have the effect of reducing the tendency for grain growth, by serving to pin the γ grain boundaries.

Following the step of supersolvus annealing 100, the cooling 105 of the article may be controlled until the temperature of the entire article is less than $T_S$ in order to control the distribution of the γ' phase. Applicants have observed that in a preferred embodiment, the cooling rate after supersolvus annealing should be in the range of 100°–600° F./minute so as to produce both fine γ' particles within the γ grains and γ' within the grain boundaries. Typically the cooling is controlled until the temperature of the forged article is about 200°–500° F. less than $T_S$, in order to control the distribution of the γ' phase in the manner described above. Faster cooling rates (e.g. 600° F./minute) tend to produce a fine distribution of γ' particles within the g grains. Slower cooling rates (e.g. 100° F./minute) tend to produce fewer and coarser γ' particles within the grains, and a greater amount of γ' within the grain boundaries. Means for performing such controlled cooling are known, such as the use of air jets directed at the locations where cooling control is desired.

The same controlled cooling may be employed if the forged article is exposed entirely to subsolvus annealing as described above, with the obvious exception that the cooling begins at a temperature that is already subsolvus. Cooling control would be maintained in the same fashion, by controlling the cooling rate until the temperature of the forged article is well under the solvus temperature, typically 200°–500° F.

The step of controlled cooling 105 may also be used to produce a forged article with location specific properties by using gradient cooling (different cooling rates at different locations within the article) so as to vary the distribution of the γ' phase at these locations.

Another method for producing location specific properties would involve the use of the method of the present invention on a preform with a plurality of different location specific compositions, such that the γ' solvus temperature would vary at the locations having different compositions, or such that the γ' distribution of the different compositions would vary in the event that the solvus temperatures are similar. This method would be expected to produce either grain size or γ' distribution differences, or both, that would in turn develop location specific alloy properties.

EXAMPLE 1

Forging preforms were selected of a Ni-base superalloy known by the tradename Rene'88, Ni-13Co-16Cr-4Mo-4W-1.7Al-3.4Ti-0.7Nb-0.05Zr-0.05C-0.015B in weight percent. The preforms were formed by hot-extruding a powder of this alloy at about 1950° F. The grain size of the preforms was about 1–5 μm.

The preforms were then forged under a variety of temperature ($T_S$) and strain rate conditions as shown in Table 2. $T_S$ for Rene'88 is about 2030° F. The supersolvus annealing was performed at 2100° F. for 2 hours. The soak referred to in Table 2 is a soak at the forging temperature for the purpose of stabilizing the grain size of the preform prior to forging, but it was not employed in this example.

TABLE 2

Rene'88 Grain Size as a Function of Forging Temperature/Strain Rate (Isothermal Forge + Anneal at 2100° F./2 hrs)

| Temp. | Soak | Strain Rate ($s^{-1}$) | | |
|---|---|---|---|---|
| (°F.) | (4 hrs) | 0.01 | 0.001 | 0.0001 |
| 1975 | N | 15 μm | 13 μm | 15 μm |
| | Y | | | |
| 2020 | N | 17 μm | 31 μm | 58 μm |
| | Y | | | |
| 2060 | N | 38 μm | 45 μm | 134 μm |
| | Y | | | |
| 2100 | N | 38 μm | 39 μm | 57 μm |
| | Y | | | |

The resultant grain sizes are averages based on a plurality of grain size measurements made on the individual forged articles. As can be seen, the grain size range of about 50–150 μm can be achieved by the combination of supersolvus forging in the temperature range of about 2060°–2100° F. (about 30°–70° F. above $T_S$) and strain rate range of about 0.001–0.0001 $s^{-1}$.

Figure 4:
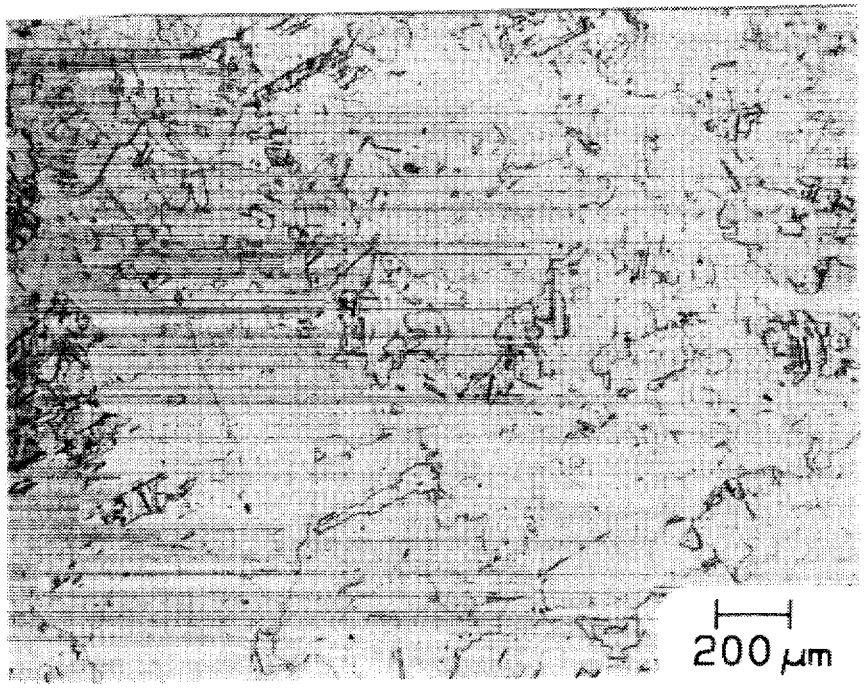
FIG. 4 is an optical photomicrograph illustrating the grain size and morphology of a Rene'88 alloy forged using the method of the present invention.

In this example, the cooling rate was not controlled. The resultant etched microstructure of one of the samples is shown in FIG. 4, which is an optical photomicrograph taken at 50× magnification of the sample forged at 2060° F. and a strain rate of 0.001 $s^{-1}$. The surface shown was etched using Walker's reagent, a commonly known etchant for Ni-base superalloys. The microstructure reveals γ grains, with γ' visible at this magnification in the grain boundaries only. Some γ' particles may also be present within the grains, but are not readily observable at this magnification.

EXAMPLE 2

Forging preforms were selected of a Ni-base superalloy known by the tradename Rene'95, Ni-8Co-14Cr-3.5Mo-3.5W-3.5Al-2.5Ti-3.5Nb-0.05Zr-0.07C-0.01B in weight percent. The preforms were formed by hot-extruding a powder of this alloy at about 1950° F. The grain size of the preforms was about 1–5 μm.

The preforms were then forged under a variety of temperature ($T_S$)and strain rate conditions as shown in Table 3. $T_S$ for Rene'95 is about 2100° F. The supersolvus annealing was performed at 2150° F. for 2 hours.

TABLE 3

Rene'95 Grain Size as a Function of Forging Temperature and Strain Rate (Isothermal Forge + Anneal at 2150° F./2 hrs)

| Temp. | Soak | Strain Rate ($s^{-1}$) | | |
|---|---|---|---|---|
| (°F.) | (4 hrs) | 0.01 | 0.001 | 0.0001 |
| 2000 | N | 20 μm | 22 μm | 27 μm |
| | Y | 20 μm | 31 μm | 35 μm |
| 2050 | N | 29 μm | 40 μm | 44 μm |
| | Y | 44 μm | 55 μm | 46 μm |
| 2075 | N | 48 μm | 55 μm | 48 μm |
| | Y | | | |
| 2100 | N | 53 μm | 59 μm | 144 μm |
| | Y | 54 μm | 95 μm | 155 μm |
| 2150 | N | 65 μm | 78 μm | 81 μm |
| | Y | 61 μm | 121 μm | 113 μm |

The resultant grain sizes are averages based on a plurality of grain size measurements made on the individual forged articles. As can be seen, the grain size range of about 50–150 μm can be achieved by the combination of soaking and supersolvus forging in the temperature range of about 2100°–2150° F. (about 0°–50° F. above $T_S$) and strain rate range of about 0.01–0.0001 $s^{-1}$.

Figure 5:
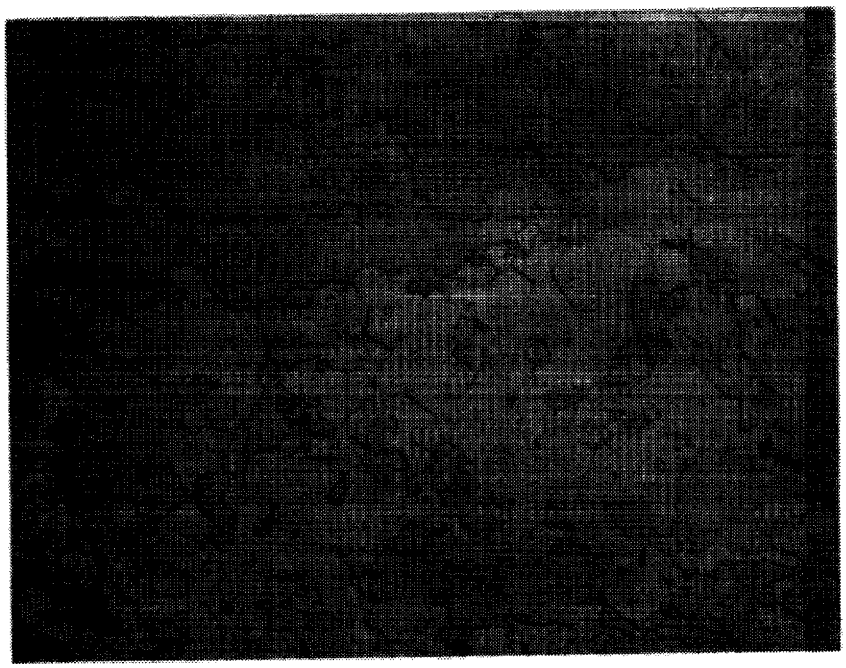
FIG. 5 is an optical photomicrograph illustrating the grain size and morphology of a Rene'95 alloy forged using the method of the present invention.

In this example, the cooling rate was not controlled. The resultant etched microstructure of one of the samples is shown in FIG. 5, which is an optical photomicrograph taken at 50× magnification. The surface shown was etched using Walker's reagent, a commonly known etchant for Ni-base superalloys. The microstructure reveals γ grains, with γ' visible as particles within the grains. Some γ' particles may also be present within the grain boundaries, but are not readily observable at this magnification.

The preceding description and examples are intended to be illustrative and not limiting as to the method of the present invention.

What is claimed is:

1. A method of producing a forged article which has a grain size within a range of about 50–150 microns from a Ni-base superalloy, comprising the steps of:

selecting a forging preform which has a grain size within a range of about 1–40 microns formed from the Ni-base superalloy and having a microstructure comprising a mixture of γ and γ' phases, a γ' solvus temperature and an incipient melting temperature, wherein the γ' phase occupies at least 40% by volume of the Ni-base superalloy;

forging the preform at a forging temperature that is above the γ' solvus temperature and below the incipient melting temperature of the Ni-base superalloy and at a strain rate in the range of 0.01–0.0001 $s^{-1}$ for a time sufficient to form the forging preform into a forged article having a maximum grain size of about 150 microns; and cooling the forged article below the γ' solvus temperature where said forged article has the grain size within the range of about 50–150 microns.

2. The method of claim 1, further comprising a step of supersolvus annealing the forged article after said step of forging at a supersolvus annealing temperature that is above the solvus temperature and below the incipient melting temperature for a time sufficient to dissolve a portion of the γ'.

3. The method of claim 2, wherein the supersolvus annealing time is in the range of about 15 minutes to 2 hours.

4. The method of claim 2, further comprising a step of cooling the article to a temperature lower than the γ' solvus temperature at a controlled cooling rate immediately after said step of supersolvus annealing.

5. The method of claim 4, wherein the controlled cooling rate is in a range of about 100–600F.°/minute.

6. The method of claim 2, wherein the supersolvus annealing temperature is about 100F.° or less above the γ' solvus temperature.

7. The method of claim 2, further comprising step of cooling the article to a temperature lower than the γ' solvus temperature by cooling at a plurality of locations at a plurality of different location-specific cooling rates immediately after said step of supersolvus annealing, wherein the resulting forged article has a non-homogeneous distribution of γ' corresponding to the plurality of different location specific cooling rates.

8. The method of claim 1 wherein the forging preform is made by hot extrusion of Ni-base superalloy powders.

9. The method of claim 1, wherein the temperature of the forging preform during said step of forging is 100F.° or less above the γ' solvus temperature.

10. The method of claim 1, wherein the forging preform comprises a superalloy made by spray forming.

11. The method of claim 1, further comprising a step of cooling the article to a temperature lower than the γ' solvus temperature by cooling at a plurality of locations at a plurality of different location-specific cooling rates immediately after said step of supersolvus annealing, wherein the resulting forged article has a non-homogeneous distribution of γ' corresponding to the plurality of different location specific cooling rates.

12. The method of claim 1, further comprising a step of subsolvus annealing the forged article after said step of forging for a time and at a subsolvus temperature sufficient to dissolve a portion of the γ', wherein the undissolved γ' primary γ'.

13. The method of claim 12, further comprising a step of cooling the forged article to a temperature lower than the γ' solvus temperature at a controlled cooling rate immediately after the step of supersolvus annealing, wherein the γ' comprises a mixture of primary γ' and secondary γ' formed during said cooling.

14. The method of claim 13, wherein the controlled cooling rate is in a range of about 100–600F.°/minute.

15. The method of claim 14, further comprising a step of cooling the article to a temperature lower than the γ' solvus temperature at a plurality of controlled, location-specific cooling rates immediately after said step of subsolvus annealing, wherein the resulting forged article has a non-homogeneous distribution of γ' corresponding to the location specific cooling rates and the γ' comprises a mixture of primary γ' and secondary γ' formed during said cooling.

16. The method of claim 1, further comprising steps of:

subsolvus annealing the forged article after said step of forging for a time sufficient to ensure that substantially all of the forged article is at a subsolvus temperature; and supersolvus annealing the forged article immediately after said step of subsolvus annealing at a supersolvus annealing temperature that is above the solvus temperature and below the incipient melting temperature for a time sufficient to dissolve a portion of the $\gamma'$.

17. The method of claim 16, wherein the supersolvus annealing time is in a range of about 15 minutes to 2 hours.

18. The method of claim 16, further comprising a step of cooling the article to a temperature lower than the $\gamma'$ solvus temperature at a controlled cooling rate immediately after said step of supersolvus annealing.

19. The method of claim 18, wherein the controlled cooling rate is in a range of about 100–600F.°/minute.

20. The method of claim 16, wherein the subsolvus annealing temperature is about 125F.° or less below the $\gamma'$ solvus temperature.

21. The method of claim 16, wherein the supersolvus annealing temperature is about 100F.° or less above the $\gamma'$ solvus temperature.

22. The method of claim 16, further comprising a step of cooling the article to a temperature lower than the $\gamma'$ solvus temperature by cooling at a plurality of locations at a plurality of different location-specific cooling rates immediately after said step of supersolvus annealing, wherein the resulting forged article has a non-homogeneous distribution of $\gamma'$ corresponding to the plurality of different location specific cooling rates.

* * * * *